US006477933B1

(12) United States Patent
McNulty, Jr. et al.

(10) Patent No.: US 6,477,933 B1
(45) Date of Patent: Nov. 12, 2002

(54) DART PROPULSION SYSTEM FOR REMOTE ELECTRICAL DISCHARGE WEAPON

(75) Inventors: James F. McNulty, Jr., Calimesa, CA (US); John F. Chudy, II, Yucaipa, CA (US)

(73) Assignee: Yong S. Park, Los Angeles, CA (US)

( * ) Notice: Subject to any disclaimer, the term of this patent is extended or adjusted under 35 U.S.C. 154(b) by 0 days.

(21) Appl. No.: 09/826,161

(22) Filed: Apr. 3, 2001

(51) Int. Cl.[7] ..... F41B 7/00

(52) U.S. Cl. ..... 89/1.34; 124/20.3; 124/22; 124/36

(58) Field of Search ..... 89/1.34; 102/357; 124/20.3, 21, 22, 36

(56) References Cited

U.S. PATENT DOCUMENTS 542,315 A * 7/1895 Sanguinette
1,866,926 A * 7/1932 Colby
5,020,437 A * 6/1991 Rieger et al. ..... 104/489
5,167,902 A * 12/1992 McCray et al. ..... 266/45
5,440,994 A * 8/1995 Alexander ..... 102/439
5,786,546 A * 7/1998 Simson ..... 102/438
5,996,504 A * 12/1999 Lowery ..... 102/504

FOREIGN PATENT DOCUMENTS

CH 432 297 * 9/1967 ..... 102/357

* cited by examiner

*Primary Examiner*—Stephen M. Johnson
(74) *Attorney, Agent, or Firm*—Leonard Tachner

(57) ABSTRACT

A wire-tethered dart cartridge for electrical discharge weapons wherein the sudden force needed to propel the darts toward a remote target is derived from a source of energy other than expanding gas. The propulsive force is derived from potential energy stored in at least one coiled spring having an arm which impacts the dart with sufficient force to propel the dart a desired distance toward a remote target. In a preferred embodiment disclosed herein, the spring is formed on two interconnected coils, each end of the spring wire extending from a respective coil and forming an impact arm for striking the back of a dart. The arms are maintained in a tensioned configuration by a retention bracket which is connected to a piston pyrotechnic device. When an electrical voltage is applied to the pyrotechnic device, the ignition forces the piston to move the retention bracket to suddenly release the arms. The potential energy in the springs then forces the arms to rotate around their respective coils at high speed and impact the respective darts.

5 Claims, 5 Drawing Sheets

DART PROPULSION SYSTEM FOR REMOTE ELECTRICAL DISCHARGE WEAPON

BACKGROUND OF THE INVENTION

1. Field of the Invention

The present invention relates generally to the field of electrical discharge weapons of the type which propel a pair of wire-tethered darts to impact a remote target. The invention herein relates more specifically to a wire-tethered dart cartridge which employs potential energy in the form of a coiled spring to impart kinetic energy to the darts to propel them toward a target.

2. Background Art

U.S. Pat. No. 3,803,463 discloses an apparatus for connecting a disabling electrical power supply to a remote animal target by means of dart(s) and trailing wire(s). A prior art reference in U.S. Pat. No. 5,654,867 describes the use of gases expanding from a pyrotechnic explosion to propel a pair of electrically opposed darts from such an electrical discharge weapon.

The most relevant prior art reference appears to be U.S. Pat. No. 5,078,117 which discloses the use of the sudden release of pressurized gas to propel a ballistic device. The sudden release of pressurized gas is effective in propelling ballistic devices over limited distances. Industry currently uses this claimed method of suddenly releasing pressurized gas to propel darts from an electrical discharge weapon. The use of such a propulsion technique in an electrical discharge weapon against a remote target, is beneficial because the weapon is not classified as a firearm. Thus, it may be used by civilians for self-defense without restrictions and regulations that would otherwise be required by state or federal law if the weapon were classified as a firearm. Even though a pyrotechnic device is used to penetrate the container of the pressurized gas, because the ballistic devices (i.e., darts) are not propelled by the energy of the pyrotechnic device, the definition of a firearm is avoided under the various applicable laws.

Unfortunately, the use of the sudden release of a pressurized gas to propel wire-tethered darts does introduce certain unpredictable results. Principally, for a number of reasons, the accuracy and repeatability of the ballistic results imparted to the darts are less than would be desirable. One reason for this unpredictability is the method of releasing the gas. More specifically, a pyrotechnic device is electrically ignited to propel a pointed penetrator toward the container of the pressurized gas and rupture the container. The inexact nature of the ignition, the penetrator and the container, as well as the gas pressure itself, contribute to variation in the precise geometry of the rupture. As a result, the escaping gas does not follow a predictable path in exiting the container. The gas may therefore impact each of the two separate darts differently. Moreover, the gas flow is likely to be turbulent as pressure builds behind and around each dart, particularly as each dart exits the cartridge. All of these effects produce ballistic inaccuracy which makes it less likely that the darts will hit the intended target at all, let alone hit the target at specific locations where the electric discharge can be effective.

Thus, there is a need to find an alternative wire-tethered dart propulsion system which has the advantage of not being classified as a firearm, but which does not rely on sudden release of pressurized gas that is likely to diminish the accuracy of the weapon.

SUMMARY OF THE INVENTION

The present invention meets the aforementioned need by providing a dual wire-tethered dart cartridge for electrical discharge weapons wherein the sudden force needed to propel the darts toward a remote target is derived from a source of energy which does not rely on the use of a pressurized gas. While a pyrotechnic device is used to release the energy, like the prior art, the pyrotechnic-derived energy does not propel the darts. Therefore, the invention also provides the advantage of not being classified as a firearm under state and federal law. Furthermore, the propulsive force is derived from potential energy stored in at least one coiled spring having an arm which impacts the dart with sufficient force to propel the dart a desired distance toward a remote target. In a preferred embodiment disclosed herein, the spring is formed on two interconnected coils, each end of the spring wire extending from a respective coil and forming an impact arm for striking the back of the dart. The arms are maintained in a tensioned configuration by a retention bracket which is connected to a piston having a pyrotechnic device. When an electrical voltage is applied to the pyrotechnic device, the ignition forces the piston to move the retention bracket to suddenly release the arms. The potential energy in the springs then forces the arms to rotate around their respective coils at high speed and impact the respective darts.

Because the invention does not require penetration of a pressurized gas container, the uncertainties of the gas container penetration and the gas flow turbulence are entirely avoided. Therefore, the transfer of energy from the spring to the darts is more predictable and repeatable and easier to adjust from cartridge to cartridge during manufacture. The result is a more accurate ballistic performance as compared to the prior art gas propelled system.

OBJECTS OF THE INVENTION

It is therefore a principal object of the present invention to provide a cartridge having wire-tethered darts for use in an electrical discharge weapon wherein the darts are propelled toward a remote target by the impact of an arm of a coiled spring released upon activation of the weapon.

It is another object of the invention to provide a gas-less dart propulsion system in a cartridge having wire-tethered darts for use in an electrical discharge weapon.

It is yet another object of the invention to provide a propulsion system for wire-tethered darts in an electrical discharge weapon system wherein the darts are propelled by a spring instead of a sudden release of a pressurized gas from a penetrated container.

It is yet another object of the invention to provide an electrically activated cartridge for propelling darts toward a remote target in an electrical discharge weapon wherein a pyrotechnic device is employed to release tensioned spring arms to impact the darts to impart energy thereto.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
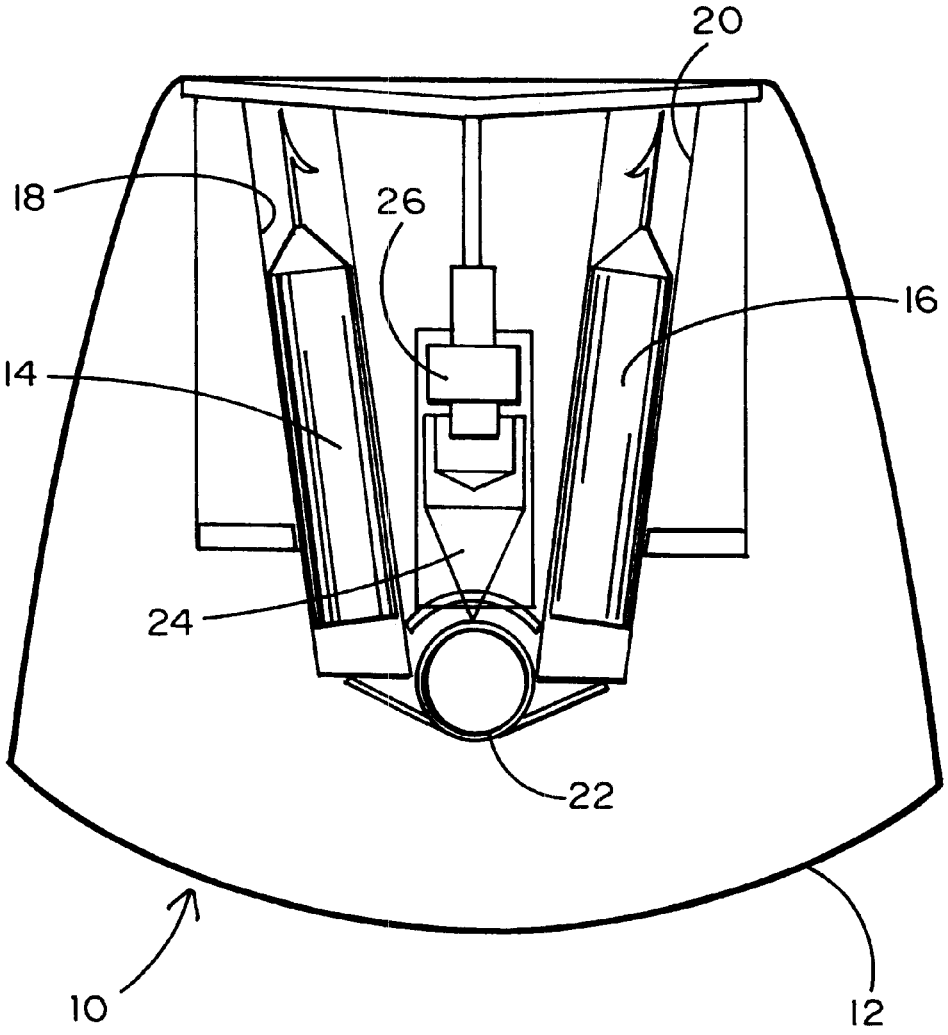
FIG. 1 (PRIOR ART)
FIG. 1 is a prior art drawing of a gas-based propulsion system.
Figure 2:
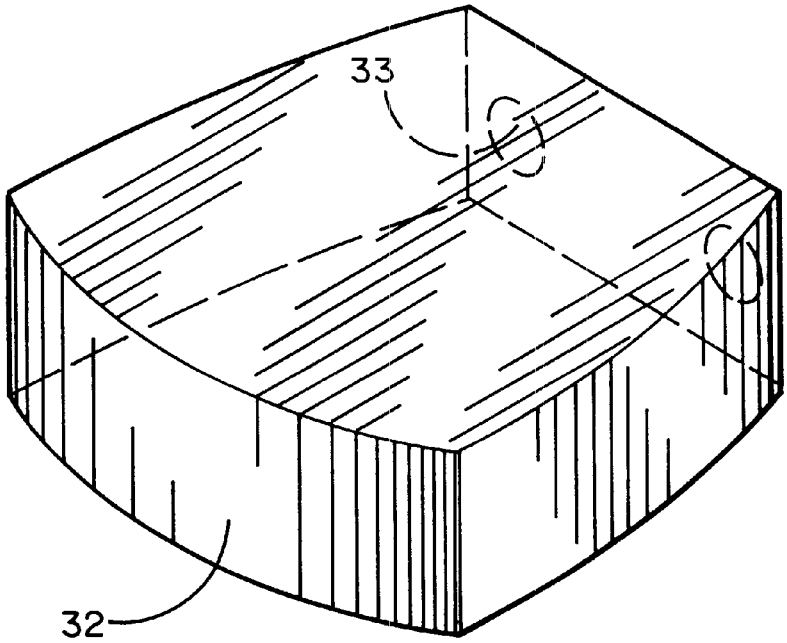
FIG. 2 is a three-dimensional view of the housing of the inventive cartridge.
Figure 3:
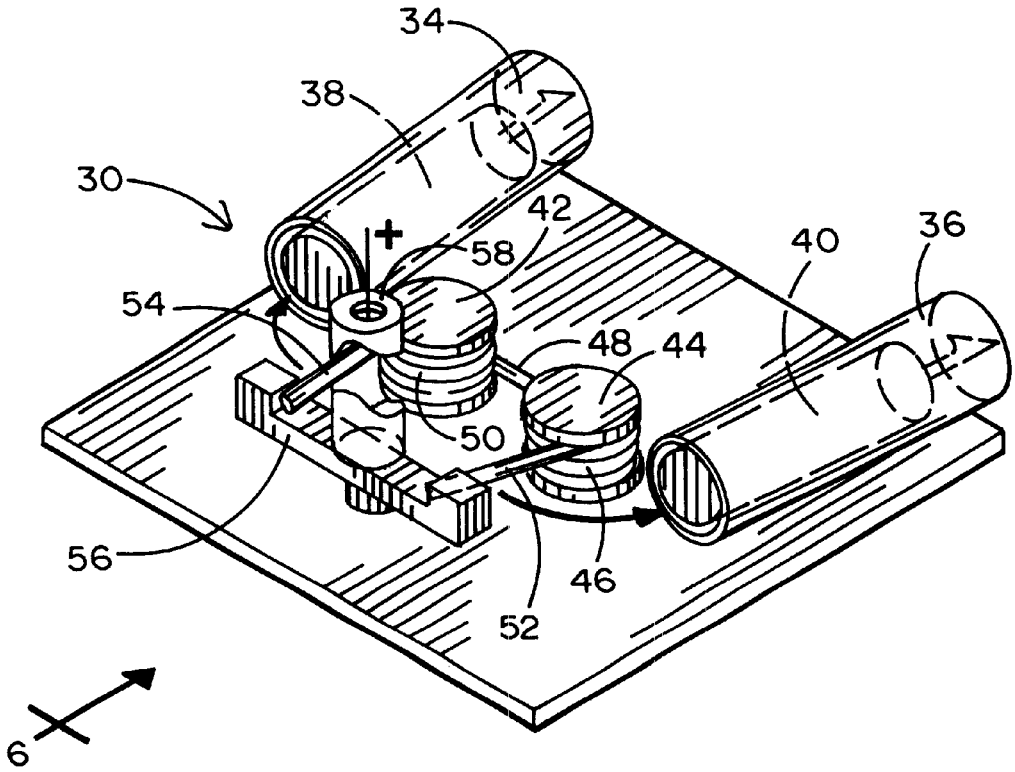
FIG. 3 is a three-dimensional view of the preferred embodiment of the invention.
Figure 5:
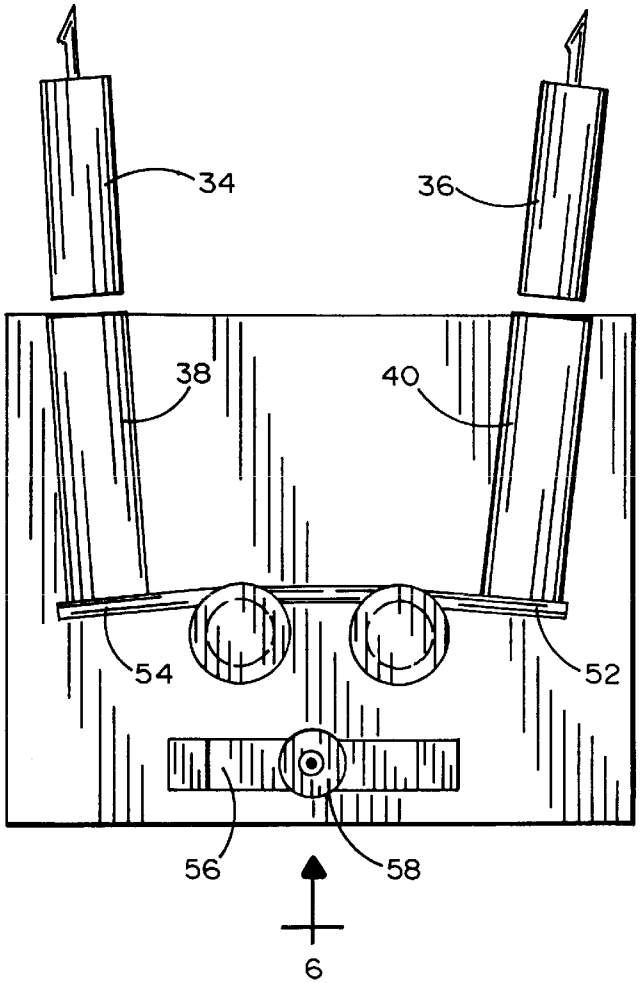
FIG. 5 is a top view of the preferred embodiment immediately following activation.
Figure 4:
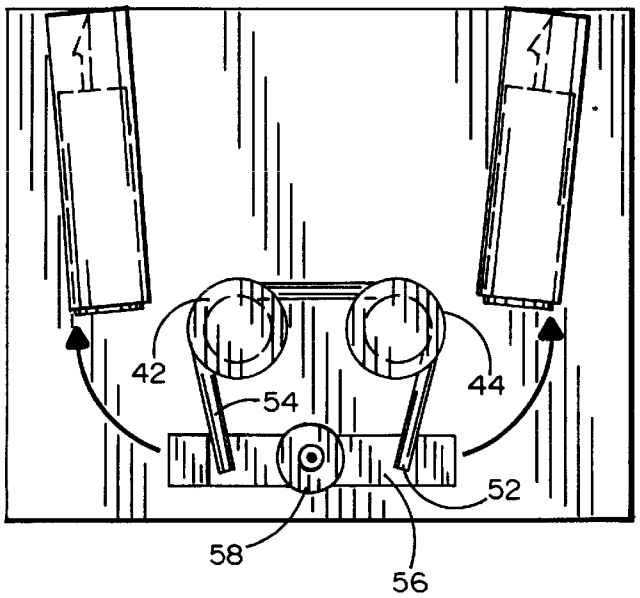
FIG. 4 is a top view of the preferred embodiment prior to activation.
Figure 6:
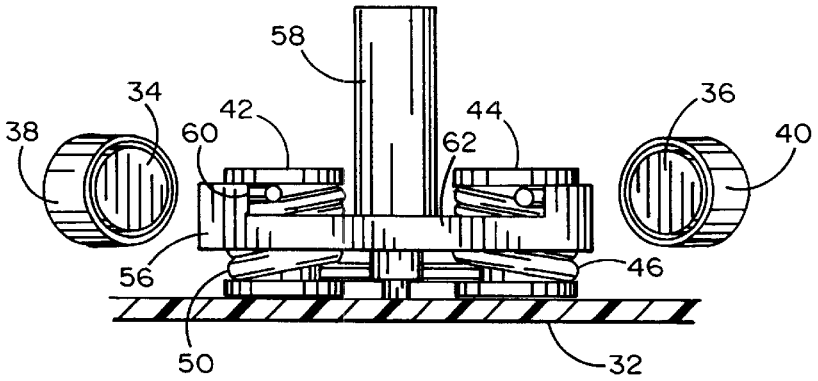
FIG. 6 is a side view of the preferred embodiment prior to activation.
Figure 7:
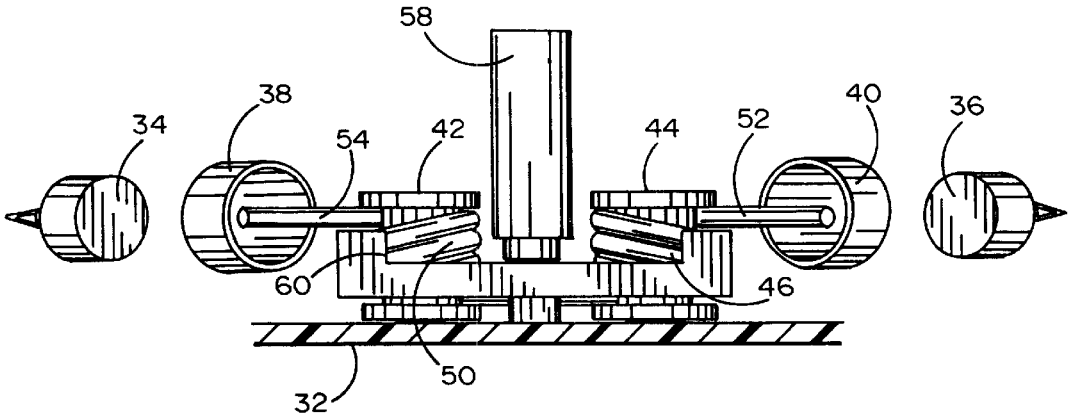
FIG. 7 is a side view of the preferred embodiment immediately following activation.

Referring to the accompanying figures and FIG. 1 in particular, it will be seen that a prior art dart cartridge 10 comprises a housing 12, a pair of wire-tethered darts 14, 16, a pair of channels 18, 20, a gas container 22, a penetrator 24 and a pyrotechnic device 26. Darts 14, 16 are shown without their respective tether wires to avoid obfuscation of the structural features of this prior art device.

In operation of prior art cartridge 10, upon activation of the pyrotechnic device 26, the penetrator 24 is thrust into the container 22 creating a rupture in the wall of the container. Pressurized gas is suddenly released through the ruptured wall and is directed into channels 18, 20. The sudden increase in pressure in the channels behind darts 14, 16, propel the darts toward a target along respective paths out of housing 12. As previously described, the uncertainty of the wall penetration, rupture geometry and gas flow turbulence, all contribute to an unpredictable effect on the two darts. Moreover, because the gas flow is required to meander around the penetrator which is retained in the ruptured container, the direction of gas flow may affect the darts unequally, thereby further diminishing the ballistic characteristics of the weapon.

Moreover, the penetrator may crush the gas container sufficiently to allow room for the piston seal to exit its case. Hot gases expanding from the pyrotechnic explosion within the case may then exit the case to further counter the already inefficiently directed force of the escaping pressurized gas. Also, any escape of hot propellant gases from the piston case necessitates redefining the weapon as a firearm.

Referring now to FIGS. 2–9, it will be seen that the present invention comprises an entirely different form of an energy source that does not employ gas, or the sudden release of a pressurized gas from a sealed container, or the uncertainties of rupturing such a container, or the use of sudden increase in pressure behind the darts from inherently turbulent and unpredictable gas flow. Specifically, the invention herein relies instead on the use of energy stored in coiled springs and the transfer of energy to the darts by impacting the back end of each dart with a spring arm that is released upon activation of the weapon.

As seen in FIGS. 2–9, in accordance with a preferred embodiment, a dart cartridge 30 comprises a housing 32 having dart exit apertures 33, channels 34, 36 and darts 38, 40. The housing apertures, channels and darts of the illustrated embodiment are substantially unchanged from the prior art cartridge of FIG. 1. The energy source of the preferred embodiment comprises a pair of spools 42, 44 around which are wound respective spring coils 46 and 50 which are formed from a unitary length of spring steel 48. The free ends of the coils 46 and 50 form the impact spring arms 52, 54 which, upon activation of the weapon in which cartridge 30 is used, will impact and propel the darts 38, 40. The arms 52, 54 are secured in their inactivated, tensioned configuration by a retention bracket 56 which has a pair of opposed end walls 60 forming a recess 62 between them. Arms 52, 54 reside in recess 62 secured by respective end walls 60.

Figure 9:
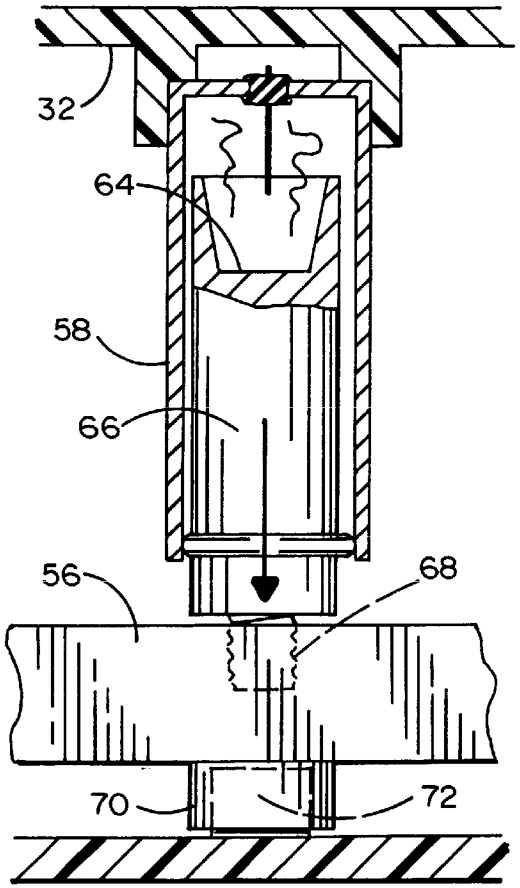
FIG. 9 is a view similar to FIG. 8, but showing the pyrotechnic device immediately after activation.
Figure 8:
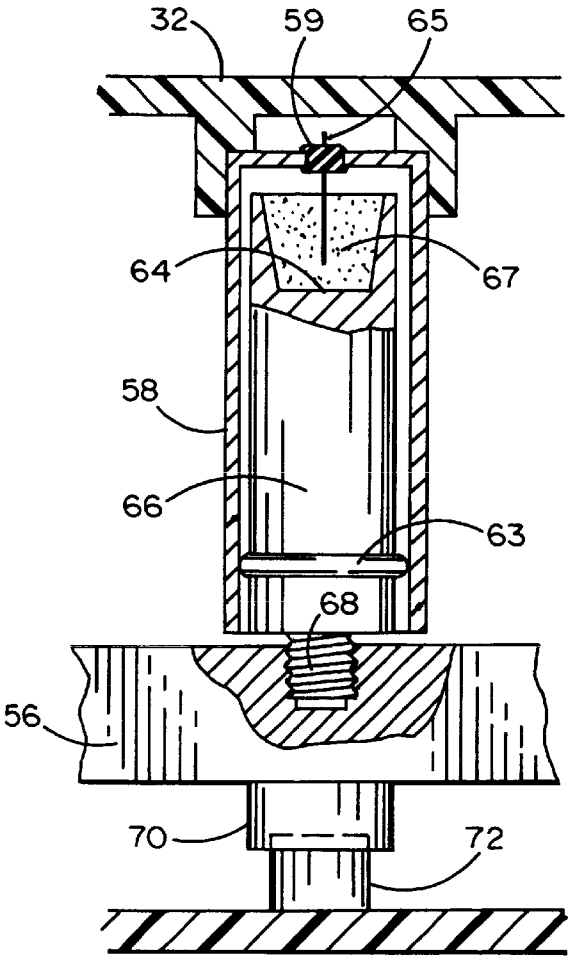
FIG. 8 is an enlarged partially cross-sectioned side view of the pyrotechnic portion of the invention prior to activation.

The activation mechanism for selectively releasing arms 52, 54 to impact the darts 38, 40, is best shown in FIGS. 8 and 9. Specifically, a pyrotechnic device 58 comprises a combustion cup 64 holding a combustible (i.e., gun powder) 67 into which an ignition wire 65 extends after passing through an insulator 59. Cup 64 is formed in an end of a piston 66 having a ring 63. The other end of piston 66 has a threaded member 68 extending into retention bracket 56. As shown in FIGS. 8 and 9, ignition of the device 58 drives the piston 66 down thereby translating bracket 56. A cylinder 70 and guide 72, assure smooth linear translation of the bracket. Bracket 56 is moved downwardly a sufficient distance to prevent walls 60 from securing spring arms 52, 54. Consequently, upon activation of the pyrotechnic device 58, the sudden translation of bracket 56 releases arms 52, 54 which rapidly swing through respective paths striking the darts 38, 40. The spring constant and the degree of tensioning are selected to provide a desired impact force to achieve a sufficient transfer of momentum to the darts to propel them toward the target over the required distance. Use of a unitary length of spring steel 48 improves the probability of equal energy transfer to both darts and use of a single retention bracket translated by activation of a single pyrotechnic device improves the probability of simultaneous energy transfer to both darts. Moreover, the precise geometry of the spring and the coils, increases the probability of predictable and repeatable results (i.e., ballistic performance of the darts) from one cartridge to the next. Thus, it will be seen that the illustrated embodiment of the invention appears to meet the aforementioned objects of the present invention.

Having the benefit of the disclosure of the preferred embodiments, those having ordinary skill in the relevant art, will now perceive various modifications and additions which may be made to that embodiment. By way of example, the precise geometry of the spring coils as well as their position relative to the darts and even the implementation of retention and release of the spring arms, may be readily altered while still achieving the desired results. Accordingly, the invention is not limited by the disclosed exemplary embodiment, but only by the appended claims and their equivalents.

What is claimed is:

1. In combination with an electrical discharge weapon a dart propulsion apparatus having a pair of wire-tethered darts to be propelled toward a remote target from the electrical discharge weapon; the apparatus comprising:

a pair of coiled springs, each having a free end configured as an impact arm for striking a respective one of said wire-tethered darts;

a retention device securing said arms in a tensioned state; and a translation device attached to said retention device and responsive to activation of said weapon to translate said retention device away from said impact arms to permit said arms to strike said darts and propel said darts from said weapon.

2. The apparatus recited in claim 1 wherein said translation device comprises a pyrotechnic actuated piston which applies thrust to said retention device.

3. The apparatus recited in claim 1 wherein said retention device comprises a bracket having a recess for receiving said impact arms.

4. The apparatus recited in claim 1 further comprising a pair of spools positioned at selected locations relative to said darts, and wherein said coiled springs are installed on said spools.

5. The apparatus recited in claim 1 further comprising a housing enclosing said apparatus and having a pair of channels in which said darts are positioned respectively, prior to being propelled by said impact arms, said housing having a pair of apertures respectively aligned with said channels to permit said darts to exit said housing after being struck by said impact ar ms.

* * * * *